US005444460A

United States Patent [19]

Fujitaka et al.

[11] Patent Number: 5,444,460

[45] Date of Patent: Aug. 22, 1995

[54] APPARATUS FOR DISPLAYING OUTLINED CHARACTERS IN A VIDEO DISPLAY SYSTEM

[75] Inventors: Shigeaki Fujitaka; Akio Kiji, both of Hyogo, Japan

[73] Assignee: Mitsubishi Denki Kabushiki Kaisha, Tokyo, Japan

[21] Appl. No.: 138,152

[22] Filed: Oct. 15, 1993

[30] Foreign Application Priority Data

Oct. 21, 1992 [JP] Japan ..... 4-307562

[51] Int. Cl.[6] ..... G09G 1/06

[52] U.S. Cl. ..... 345/144; 345/114; 345/116; 345/194

[58] Field of Search ..... 345/113–116, 345/118, 141, 144, 194

[56] References Cited

U.S. PATENT DOCUMENTS

| | | | |
|---|---|---|---|
| 4,437,092 | 3/1984 | Dean et al. | 345/113 X |
| 4,734,619 | 3/1988 | Havel | 345/114 X |
| 4,868,781 | 9/1989 | Kimura et al. | 345/113 X |
| 4,924,299 | 5/1990 | Mizumo et al. | 345/113 X |
| 5,200,739 | 4/1993 | Eland | 345/114 |

*Primary Examiner*—Ulysses Weldon
*Attorney, Agent, or Firm*—Townsend and Townsend Khourie and Crew

[57] ABSTRACT

A circuit for reducing the number of times a character read-only memory (ROM) in a video display must be accessed in order to display outlined characters. For each pixel on a scan line in a character to be displayed the circuit outputs information on the current scan line and the scan lines above and below the current scan line. The pixels above and below the current pixel on the current scan line are summed and output as a single value. Thus, the number of accesses to the character ROM is reduced from three to two.

3 Claims, 15 Drawing Sheets

FIG. 5A. DISPLAY CLOCK

FIG. 5B. X 1

FIG. 5C. ADDRESS DECODE SIGNAL

FIG. 5D. CHARACTER FONT DATA

FIG. 5E. X 2

FIG. 5F. OUTPUT OF BIT SIGNAL CONTROL CIRCUIT B2

FIG. 5G. OUTPUT OF BIT SIGNAL CONTROL CIRCUIT B3

FIG. 5H. OUTPUT OF BIT SIGNAL CONTROL CIRCUIT B4

FIG. 5I. OUTPUT DATA

FIG. 5J. OUTLINING INSTRUCTION SIGNAL Z

FIG. 7A. DISPLAY CLOCK

FIG. 7B. X1

FIG. 7C. ADDRESS DECODE SIGNAL

FIG. 7D. CHARACTER FONT DATA

FIG. 7E. X2

FIG. 7F. OUTPUT OF BIT SIGNAL CONTROL CIRCUIT B2

FIG. 7G. OUTPUT OF BIT SIGNAL CONTROL CIRCUIT B3

FIG. 7H. OUTPUT OF BIT SIGNAL CONTROL CIRCUIT B4

FIG. 7I. OUTPUT DATA

FIG. 7J. OUTLINING INSTRUCTION SIGNAL Z

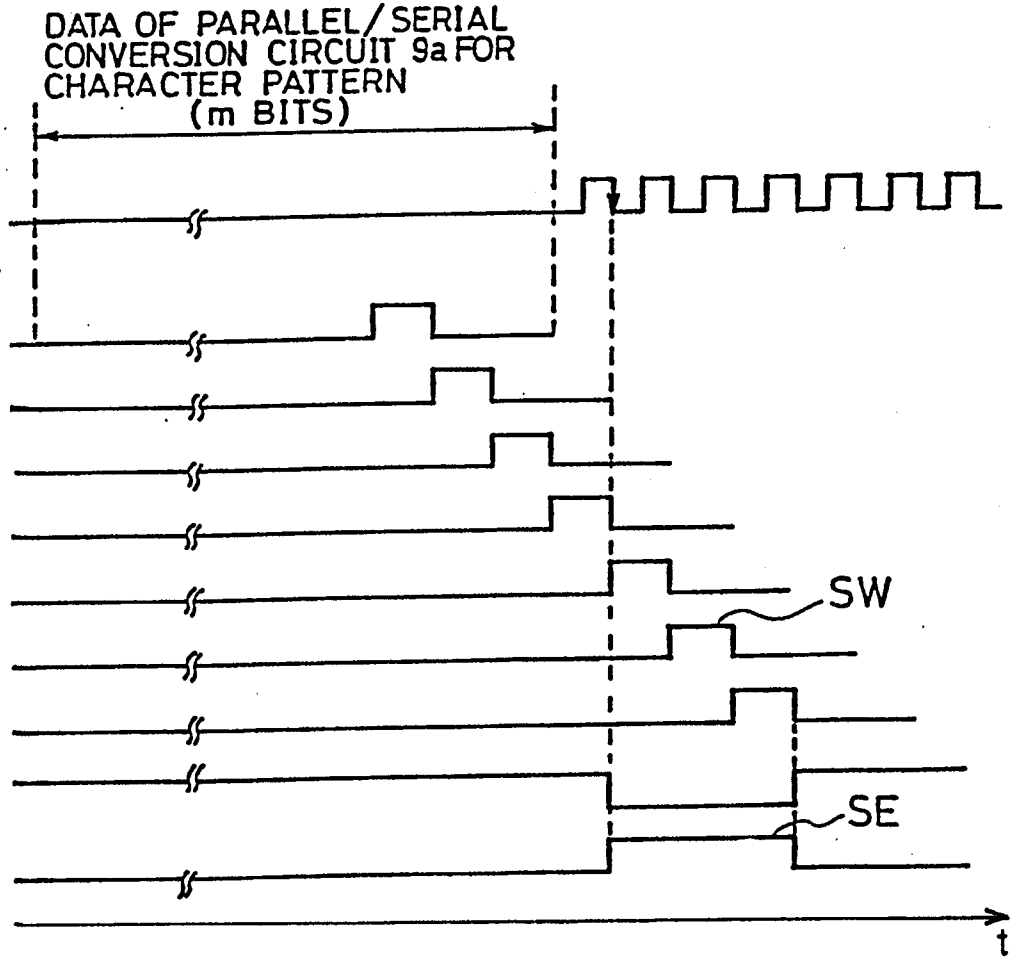
FIG. 14A. CLOCK CK
FIG. 14B. DATA RECEIVED BY PARALLEL/SERIAL CONVERSION CIRCUIT FOR CHARACTER PATTERN
FIG. 14C. AFTER ONE CLOCK
FIG. 14D. AFTER TWO CLOCKS
FIG. 14E. POSITION "a"
FIG. 14F. POSITION "b"
FIG. 14G. POSITION "c" (CHARACTER DISPLAY SIGNAL)
FIG. 14H. POSITION "d"
FIG. 14I. POSITION "e"
FIG. 14J. POSITION "f" (OUTLINE DISPLAY SIGNAL)

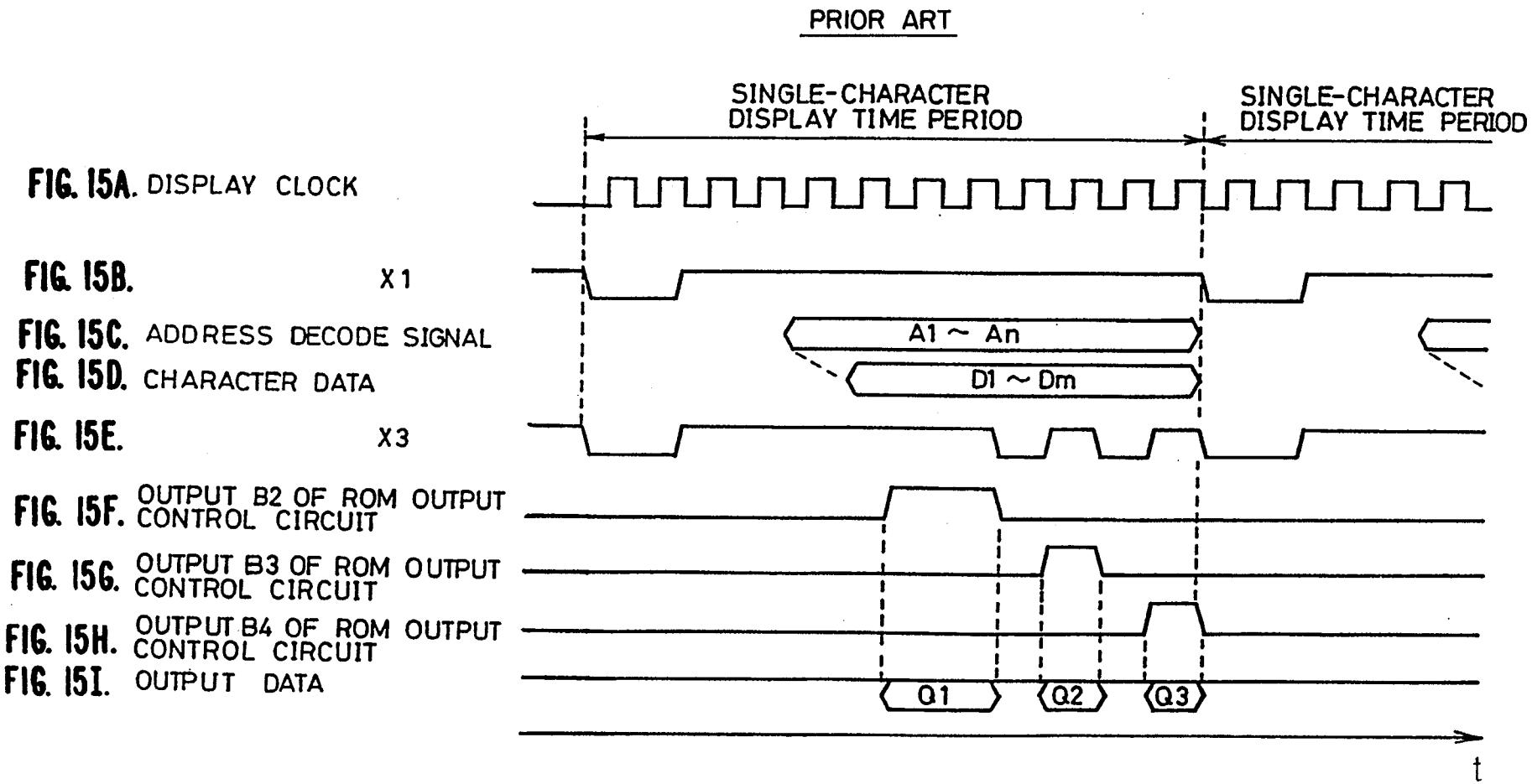
PRIOR ART
SINGLE-CHARACTER DISPLAY TIME PERIOD
SINGLE-CHARACTER DISPLAY TIME PERIOD
A1 ~ An
D1 ~ Dm
Q1
Q2
Q3
t
FIG. 15A. DISPLAY CLOCK
FIG. 15B. X1
FIG. 15C. ADDRESS DECODE SIGNAL
FIG. 15D. CHARACTER DATA
FIG. 15E. X3
FIG. 15F. OUTPUT B2 OF ROM CONTROL CIRCUIT OUTPUT
FIG. 15G. OUTPUT B3 OF ROM CONTROL CIRCUIT OUTPUT
FIG. 15H. OUTPUT B4 OF ROM CONTROL CIRCUIT OUTPUT
FIG. 15I. OUTPUT DATA 12 DOTS
18 DOTS
SW
t
CURRENT SCANNING SE
t
CURRENT SCANNING
CURRENT SCANNING
TO FIG.16(c)

CURRENT SCANNING

FROM FIG.16(b)

APPARATUS FOR DISPLAYING OUTLINED CHARACTERS IN A VIDEO DISPLAY SYSTEM

BACKGROUND OF THE INVENTION

1. Field of the Invention

The present invention relates to a screen display device for displaying characters and patterns such as the channel number and sound volume superimposed upon an image broadcast on a TV or VTR display screen.

2. Description of the Prior Art

FIG. 8 is a system block diagram of a prior art screen display device.

In the figure, reference numeral 1 represents a synchronous signal input circuit through which a horizontal synchronous signal HSYNC and a vertical synchronous signal VSYNC included in an image signal for TV and the like are input into an oscillator circuit 2 and a display position detection circuit 3. The display position detection circuit 3 detects the display position of a character or pattern based on these synchronous signals, and its output is input into a timing generator 4 and a display control circuit 5. The oscillator circuit 2 is reset for each horizontal synchronous signal HSYNC and oscillates at a predetermined frequency.

This oscillation output of this oscillator circuit 2 is input into the timing generator 4. The timing generator 4 generates a clock required for the operation of each part based on the oscillation output and provides the clock to an input control circuit 6, a display memory 7, a vertical-direction outlining control circuit 8A, a horizontal-direction outlining control circuit 9, a character ROM 10A and the display control circuit 5.

Meanwhile, code data CD (including commands such as display start, display stop and an outlining instruction, character codes and the like) from an unshown microcomputer for displaying a desired character or pattern are input into the display memory 7 through the input control circuit 6. The display memory 7 stores the input code data. The code data stored in the display memory 7 are read sequentially for display, and the read code data are input as addresses into the character ROM 10A which stores character font data for characters and patterns to be displayed. An outlining instruction signal Z is input into the vertical-direction outlining control circuit 8A for outputting a precharge signal X3 for outlining a display image in a vertical direction thereof and the horizontal-direction outlining control circuit 9 for outlining the display image in a horizontal direction thereof. FIG. 9 is a diagram showing the internal configuration of the vertical-direction outlining control circuit 8A. The vertical-direction outlining control circuit 8A consists of an X1 signal generator 81 for generating a precharge signal X1 only once at the beginning of a single-character display time-period and an X3 signal generator 82A for generating a precharge signal X3 three times within the single-character display time period when it receives the outlining instruction signal Z. The precharge signal X1 output from the vertical-direction outlining control circuit 8A once at the beginning of the single-character display time period is input into the character ROM 10A, and the precharge signal X3 output three times within the single-character display time period is input into the ROM data output control circuit 11. Character font data read from the character ROM 10A is input into the horizontal-direction outlining control circuit 9 through the ROM data output control circuit 11. The output SC (a character display signal SQ and an outline display signal SE to be described hereinafter) of the horizontal-direction outlining control circuit 9 is supplied to an unshown CRT through the display control circuit 5 to control display colors, for example.

One font is composed of 1×x m dot pixels, for example, as shown in FIG. 10. The character ROM 10A has a storage capacity of 1×m×n dots for storing n character fonts.

FIG. 11 is a structural diagram illustrating the character ROM 10A, the vertical-direction outlining control circuit 8A and the ROM data output control circuit 11, together with the horizontal-direction outlining control circuit 9.

The character ROM 10A comprises an address decoder circuit 12 to which code data from the display memory 7 are input, a ROM output control circuit 13 to which a clock signal CK from the timing generator 4 is input, and an m numbers of storage areas **14*a* through 14*m*. Address decode signals A1 through An output from the address-decoder circuit 12 and bit signals B1 through Bl output from the ROM output control signal 13 are input into the storage areas 14*a* through 14*m*. Data stored in the storage areas 14*a* through 14*m* are input into the horizontal-direction outlining control circuit 9** through data lines DL1 through DLm.

The outlining instruction signal Z and the clock signal CK are input from the display memory 7 and the timing generator 4 to the vertical-direction outlining control circuit 8A, respectively. The precharge signal X1 output from the vertical-direction outlining control circuit 8A is input into the storage areas **14*a* through 14*m***.

The ROM data output control circuit 11 consists of an m number of P channel MOS transistors E1 through Em, whose drains are connected to the respective data line DL1 through DLm, and whose sources are all connected to a precharge power supply VDD.

The precharge signal X3 output from the vertical-direction outlining control circuit 8A is input into the gates of the P channel MOS transistors E1 through Em.

FIG. 12 shows the details of the storage area **14*c***, for example, of the character ROM; other storage areas have the same structure, as shown in the figure.

The storage area **14*c* contains 1×n memory cells M11 to Mln arranged in a matrix form. Each memory cell consists of an N-channel MOS transistor, and the gates of memory cells in each column (M11 through Ml1), and (M12 to Ml2) to and including (M1n through Mln) are connected to respective word lines WL1 through WLn, whereas the drains of memory cells in each row (M11 through M1n), and (M21 through M2n) to and including (M11 to Mln) are connected to respective bit lines BL1 through BLl. The drain of only a bit memory cell having character font data is connected to the respective bit line BL. For instance, in FIG. 12, the drain of the memory cell M31 is connected to the bit line BL3. This is equivalent to the writing of character font data onto the position of the checkered area (image display area) in FIG. 10. Each of the word lines WL1 to WLn to which the address decode signals A1 through An are input is connected to all storage areas. In other words, each storage area stores data on each column of all (n) character fonts (see FIG. 10**), and a single font is constructed with all the memory cells connected to a single word line. The bit lines BL1 through BLl are connected to the power supply VDD through the respective P-channel MOS transistors C1 through Cl. The data lines DL1 through DLm of the storage areas are also connected to the power supply VDD through the respective P-channel MOS transistors E1 through Em. The precharge signals X1 and X3 are provided from the vertical-direction outlining control circuit 8A to the gates of the P-channel MOS transistors C1 to Cl, and E1 to Em, respectively, at the beginning of each access at a predetermined time, whereby the transistors C1 through Cl and E1 through Em become conductive, and the bit lines BL1 to BLl and the data lines DL1 to DLm are precharged.

After precharging, one of the address decode signals A1 through An is provided to the respective word line from the address decoder circuit 12 according to an address (code data) from the display memory 7.

For instance, when the address decode signal A1 is provided to the word line WL1, all the memory cells connected to this word line WL1 become conductive. In the storage area 14*c* shown in FIG. 12, the memory cells M11 through Ml1 become conductive, and the charge precharged onto the bit line BL3 is pulled out through the memory cell M31 connected to the bit line BL3.

The bit lines BL1 through BLl are all connected to the data line DL3 of the storage area 14*c* through the respective output gate transistors G1 through Gl, each of which consists of an N-channel MOS transistor. The gates of the output gate transistors G1 through Gl are connected to respective control lines CL1 through CLl. Moreover, each of the control lines CL1 to CLl is connected to all the storage areas 14*a* through 14*m*. The ROM output control circuit 13 provides the bit signals Bl through sequentially to the respective control lines CL1 to CLl upon each scanning in response to the clock of the timing generator 4. In accordance with this, in the storage area 14*c* of FIG. 12, the output gate transistors G1 to Gl become conductive sequentially so that data over the bit lines are read out sequentially to the data line DL3. The same operation is performed in other storage areas at the same time so that m-bit data is read out from each of the storage areas 14*a* through 14*m* to the respective data lines DL1 through DLm concurrently. For instance, when the bit signal B3 is input into the control line CL3, data over the third bit lines BL3 of the storage areas 14*a* through 14*m* are read out to the respective data lines DL1 through DLm concurrently. This is equivalent to the reading of m pieces of data over the third line shown by the arrow of FIG. 10. The read data are input into the horizontal-direction outlining control circuit 9.

The horizontal-direction outlining control circuit 9 comprises a parallel/serial conversion circuit 9*a* for an m-bit character pattern, and a parallel/serial conversion circuit 9*b* for an m-bit outline pattern as shown in FIG. 13. Character font data is input into these parallel/serial conversion circuits 9*a* and 9*b* from the character ROM 10A through the ROM data output control circuit 11. The output of the parallel/serial conversion circuits 9*a* (or 9*b*) is input into a flip-flop F1 (or F4) whose output is further supplied to a flip-flop F2 (or F5). Further, the output of the flip-flop F2 (or F5) is supplied to a flip-flop F3 (or F6). The output of each of these flip-flops is input into a three-input NOR circuit N1 (or N2), and the output of the flip-flop F2 is a character display signal SW. The clock CK of the timing generator 4 is input into the timing signal terminals T of the flip-flops F1 through F6. The outputs of the three-input NOR circuits N1 and N2 are input into a NOR circuit N3 which outputs an outline display signal SE through an AND circuit A controlled by the outlining instruction signal Z. The outline display signal SE and the character display signal SW are both input into the display control circuit 5.

A description is subsequently given of the basic operation of the horizontal-direction outlining control circuit. FIGS. 14(A) through (J) are timing charts of signals input into each part of the horizontal-direction outlining control circuit 9. These timing charts illustrate the status of data output by the bit signal B3 shown in FIG. 12 in the horizontal-direction outlining control circuit 9 so as to display an image at a position shown in FIG. 10. When a shift clock is input into the parallel/-serial conversion circuit 9*a* for a character pattern, data received by the parallel/serial conversion circuit 9*a* for a character pattern is shifted in the order shown, in FIGS. 14(C) and (D) in response to first and second clocks and output from the parallel/serial conversion circuit 9*a* in response to a third clock. Then, the input side "a" of the flip-flop F1 rises to "H" and falls in synchronism with a fall in the first clock CK provided from the timing generator 4 and shown in FIG. 14(A). Thereafter, each time the subsequent second and third clocks. CK are provided, the flip-flops F2 and F3 operate reversely so that data is shifted in the order shown in FIGS. 14(E), (F) and (G) and the character display signal SW is output to the display control circuit 5. When the output of the flip-flop F2 becomes "L", the output side "d" of the flip-flop F3 becomes "H" as shown in FIG. 14(H). As shown in FIG. 14(I), the output side "e" of the NOR circuit N1 turns to "L" at the time when the output side "b" of the flip-flop F1 becomes "H", and to "H" at the time when the output side "d" of the flip-flop F3 becomes "L". Thereby, the output side "f" of the NOR circuit N3 is equal to the inverted output of the output side "e" of the NOR circuit N1 as shown in FIG. 14(J) and is output as the outline display signal SE through the AND circuit A. The character display signal SW and the outline display signal SE thus obtained are both supplied to the unshown CRT through the display control circuit 5 so that the horizontal direction of the image display area is outlined by the outline display area as shown in FIG. 10.

The parallel/serial conversion circuit 9*b* for outline pattern data is shown in FIG. 13. This parallel/serial circuit works in an identical manner as the parallel/-serial conversion circuit 9*a* for the character data, discussed above.

A description is subsequently given of the operation of the screen display device.

FIGS. 15(A) through (I) are timing charts of the access operation of the character ROM 10A. In FIG. 8, when the horizontal synchronous signal HSYNC and the vertical synchronous signal VSYNC are input into the synchronous signal input circuit 1, signals related to these synchronous signals are output to the oscillator circuit 2 and the display position detection circuit 3. The oscillator circuit 2 generates a predetermined oscillation output to the timing generator 4 based on the input synchronous signals, and the display position detection circuit 3 detects the image display position of a preset screen based on the input synchronous signals in order to adjust timing of displaying an image.

Meanwhile, when code data for displaying characters and patterns are input into the input control circuit 6 from the unshown microcomputer, code data such as signals for displaying and not displaying an image, an outlining instruction signal and character codes are written continuously onto the display memory 7 in response to a clock from the timing generator 4. The contents of the display memory 7 are read sequentially, read code data are input into the character ROM 10A, and the outlining instruction signal Z is input into the vertical-direction outlining control circuit 8A and the horizontal-direction outlining control circuit 9. Thereby, the address decoder circuit 12 of the character ROM 10A generates address decode signals A1 through An shown in FIG. 15(C) corresponding to the input code data and the storage areas output character font data D1 through Dm shown in FIG. 15(D).

In other words, the vertical-direction outlining control circuit 8A outputs a precharge signal X1 shown in FIG. 15(B) which is set at an "L" level at the beginning of the single-character display time period. The bit lines BL1 through BLl of each storage area are precharged while the precharge signal X1 is at an "L" level. A character code from the display memory 7 is input into the character ROM 10A, whereby the address decoder circuit 12 of the character ROM 10A inputs into the storage areas 14*a* through 14*m* an address decode signal corresponding to the input character code from the address decode signals A1 to An shown in FIG. 15(C). Thereby, data corresponding to the address decode signal are output as character font data D1 through Dm shown in FIG. 15(D). In each storage area, the bit signals B1 to Bl are output sequentially upon each scanning in response to the display clock CK input from the timing generator 4 to the ROM output control circuit 13 of the character ROM 10A so that character font data D1 through Dl are sequentially read out upon each scanning.

Moreover, when the vertical-direction outlining control circuit 8A receives the outlining instruction signal Z, it outputs the precharge signal X3 shown in FIG. 15(E) which becomes "L" once at the beginning of the single-character display time period and twice near the end of the period, and precharges the data lines DL1 through DLm of the character ROM 10A while the precharge signal X3 is at "L". When the ROM output control circuit 13 outputs the bit signal B3 corresponding to the current scanning, for example, as shown in FIG. 15(G), data Q2 being scanned currently shown in FIG. 15(I) is output, and when it outputs the bit signal B2 shown in FIG. 15(F), data Q1 previously scanned (past) shown in FIG. 15(I) is output. Furthermore, as shown in FIG. 15(H), when the circuit 13 outputs the bit signal B4, data Q3 to be scanned next (future) shown in FIG. 15(I) is output. That is, data on dots above and below a display image area can be obtained along with data on the display image being scanned within the single-character display time period. The data Q1, Q2 and Q3 thus obtained are input into the horizontal-direction outlining control circuit 9.

At this time, the parallel/serial conversion circuit 9*a* for a character pattern receives only data Q2 upon input of data Q2 being scanned currently. The parallel/serial conversion circuit 9*b* for an outline pattern receives both data Q1 and Q3 upon input of data Q1 and Q3 scanned previously and to be scanned next, respectively.

As described in the foregoing, data of the parallel/serial conversion circuit 9*a* for a character pattern (or the parallel/serial conversion circuit 9*b* for an outline pattern) is supplied to the flip-flop F1 (or F4), the flip-flops F1, F2 and F3 (or F4, F5 and F6) operate reversely sequentially in response to the clock CK provided from the timing generator 4, and the flip-flop F2 outputs the character display signal SW. The output of the NOR circuit N1 to which the outputs of the flip-flops F1, F2 and F3 have been input and the output of the NOR circuit N2 to which the outputs of the flip-flops F4, F5 and F6 have been input are supplied to the NOR circuit N3, which outputs the outline display signal SE through the AND circuit A. Then, the character display signal SW and the outline display signal SE are supplied to the display control circuit 5 so as to control display such as display colors, and then to the unshown CRT.

In the case of scanning the position shown by the arrow in FIG. 10, data on the image display area, that is, data for obtaining an image, is supplied from the parallel/serial conversion circuit 9*a* for a character pattern to the flip-flop F1. Meanwhile, both data scanned previously and to be scanned next for obtaining the image, that is, data on dots above and below the image display area of FIG. 10, at rows 102 and 104, respectively, are supplied from the parallel/serial conversion circuit 9*b* for an outline pattern to the flip-flop F4. Thereafter, the time length of the outline display signal ST obtained as the output of the NOR circuit N3 and corresponding to data scanned previously, being scanned and to be scanned next is extended by the operation of the aforementioned horizontal-direction outlining control circuit 9 to enable the outline of an image in a horizontal direction thereof to be displayed. Therefore, the outline of an image in a vertical direction thereof can be displayed with both data scanned previously and to be scanned next, and the outline of the image in a horizontal direction thereof can also be displayed by extending the time length of these data.

In a case where a font for outline display is "1", the font is displayed as shown in FIGS. 16(A) through (C). When a position shown by an arrow is being scanned currently, the character display signal SW and the font are such as shown in FIG. 16(*a*). The outline display signal SE at this time and a pattern for outline display are such as shown in FIG. 16(*b*). An image displayed with the character display signal SW and the outline display signal SE is such as shown in FIG. 16(*c*) which illustrates the font "1" outlined in both vertical and horizontal directions thereof.

Since the conventional screen display device is structured as described above, it is necessary to read the character ROM three times within the single-character display time period for vertical-direction outline display, thus making it difficult to increase the speed of the device. Therefore, the device has the problem that it is inoperable at high display clock frequencies.

SUMMARY OF THE INVENTION

The present invention is intended to solve the above problem, and it is therefore an object of the present invention to provide a screen display device which permits stable outlining operation even at high display clock frequencies.

The screen display device according to the present invention comprises a display memory for storing code data for displaying characters and patterns on a screen and a character ROM which prestores character font data for the characters and patterns and from which character font data corresponding to code data read from the display memory are read out, and subjects character font data to a vertical-direction outlining process by controlling the read operation of the character ROM and further subjects the character font data subjected to the vertical-direction outlining process to a horizontal-direction outlining process for outline display. This screen display device uses the character ROM which is composed of memory cells corresponding to each column of character font data arranged in parallel and which outputs data on the logical sum of data stored in these memory cells when a plurality of memory cells are read simultaneously, and further comprises read control means which accesses the character ROM-twice within a single-character display time period at the time of outline display, once for reading data being scanned currently and the other time for simultaneous reading of both data scanned previously and to be scanned next for vertical-direction outlining.

The read control means accesses the character ROM twice within the single-character display time period at the time of outline display, once for reading data being scanned currently, and the other time for simultaneous reading of both data scanned previously and to be scanned next.

According to the present invention, stable outlining operation is ensured even at high display clock frequencies by reducing the number of times the character ROM is read within the single-character display time period to two.

All the data including data being scanned currently can be processed in the following step of the horizontal-direction outlining by simultaneous reading of all the data scanned previously, being scanned currently and to be scanned next, thus simplifying a circuit configuration for horizontal-direction outlining.

The above and other objects, features and advantages of the invention will become more apparent from the following description when taken in conjunction with the accompanying drawings.

BRIEF DESCRIPTION OF THE DRAWINGS

FIGS. 5(A)–5(J) are waveforms in the timing chart of FIG. 5;

FIGS. 7(A)–7(J) are waveforms in the timing chart of FIG. 7;

FIGS. 14(A) through 14(J) are timing charts of the horizontal-direction outlining control circuit;

FIGS. 14(A)–14(J) are waveforms in the timing chart of FIG. 14;

FIGS. 15(A) through 15(I) are timing charts showing the access operation of the character ROM of the prior art shown in FIG. 8;

FIGS. 15(A)–15(I) are waveforms in the timing chart of FIG. 15; and

DESCRIPTION OF THE PREFERRED EMBODIMENT

Embodiment 1

Figure 1:
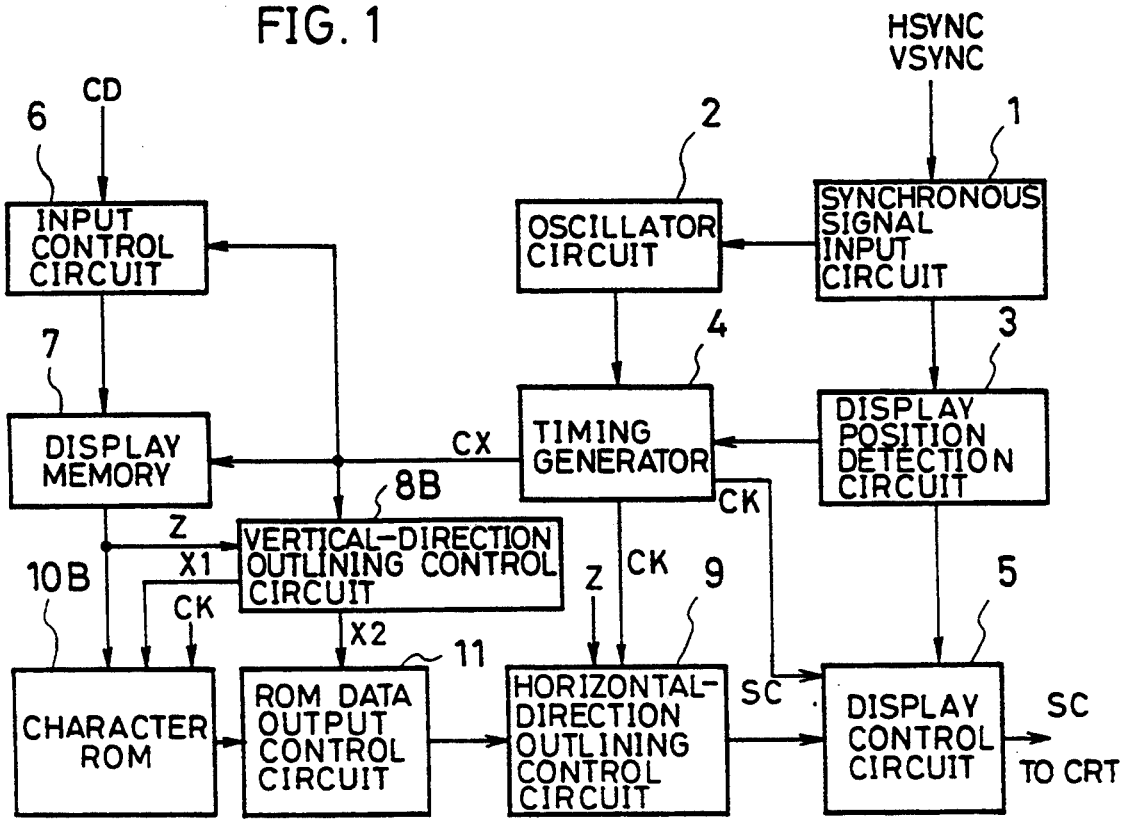
FIG. 1 is a block diagram of a screen display device according to an embodiment of the present invention.

FIG. 1 is a system block diagram of a screen display device according to an embodiment of the present invention. Like the prior art, a character ROM is of a type which reads data by precharging. In FIG. 1, reference numeral 1 represents the same synchronous signal input circuit as the prior art, through which a horizontal synchronous signal HSYNC and a vertical synchronous signal VSYNC are input into an oscillator circuit 2 and a display position detection circuit 3 as described previously. The display position detection circuit 3 detects the display position of a character or a pattern based on these synchronous signals and the output of this circuit is input into a timing generator 4 and a display control circuit 5. The oscillator circuit 2 is reset for each horizontal synchronous signal HSYNC and oscillates at a predetermined frequency.

This oscillation output of this oscillator circuit 2 is input into the timing generator 4. The timing generator 4 generates a clock required for the operation of each part based on the oscillation output and supplies it to an input control circuit 6, a display memory 7, a vertical-direction outlining control circuit 8B, a horizontal-direction outlining control circuit 9, a character ROM 10B and the display control circuit 5.

Figure 2:
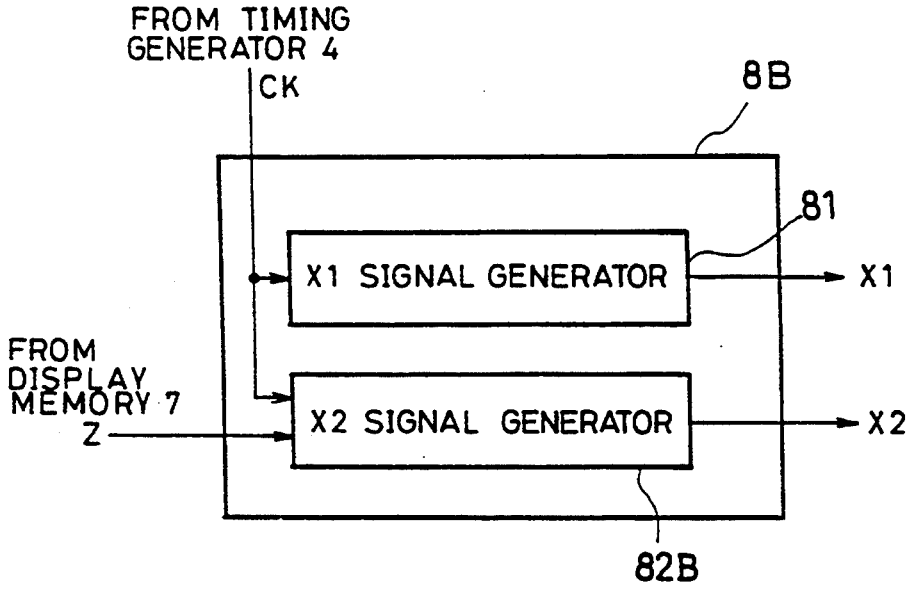
FIG. 2 is a diagram illustrating an example of the vertical-direction outlining control circuit of FIG. 1.

Meanwhile, code data CD (commands such as display start, display stop and an outlining instruction, character codes and the like) for displaying a desired character or pattern are input from an unshown microcomputer to the display memory 7 through the input control circuit 6. The display memory 7 stores the input code data. The code data read from the display memory 7 are input into the character ROM 10B which stores character font data for characters and patterns to be displayed, and an outlining instruction signal Z is input into the vertical-direction outlining control circuit 8B for generating a precharge signal X2 for outlining a display image in a vertical direction thereof, the horizontal-direction outlining control circuit 9 and a bit signal control circuit 15 in the character ROM 10B which will be described hereinafter. FIG. 2 is a diagram of the internal configuration of the vertical-direction outlining control circuit 8B. The vertical-direction outlining control circuit 8B of this embodiment consists of the same X1 signal generator 81 (first signal generator) as the prior art for generating a precharge signal X1 (first precharge signal) once at the beginning of the single-character display time period, and an X2 signal generator 82B (second signal generator) for generating a precharge signal X2 (second precharge signal) twice within the single-character display time period when it receives the outlining instruction signal Z. This X2 signal generator 82B generates the precharge signal twice within the single-character display time period compared with three times for the X3 signal generator of the prior art. The precharge signal X1 which is generated by the thus structured vertical-direction outlining control circuit 8B once at the beginning of the single-character display time period is input into the character ROM 10B, whereas the precharge signal X2 which is generated twice within the single-character display time period is input into the ROM data output control circuit 11. The character font data of the character ROM 10B is input into the horizontal-direction outlining control circuit 9 through the ROM data output control circuit 11. The output SC of the horizontal-direction outlining control circuit 9 is input into the unshown CRT through the afore-mentioned display control circuit 5 for controlling display colors, for example.

Figure 10:
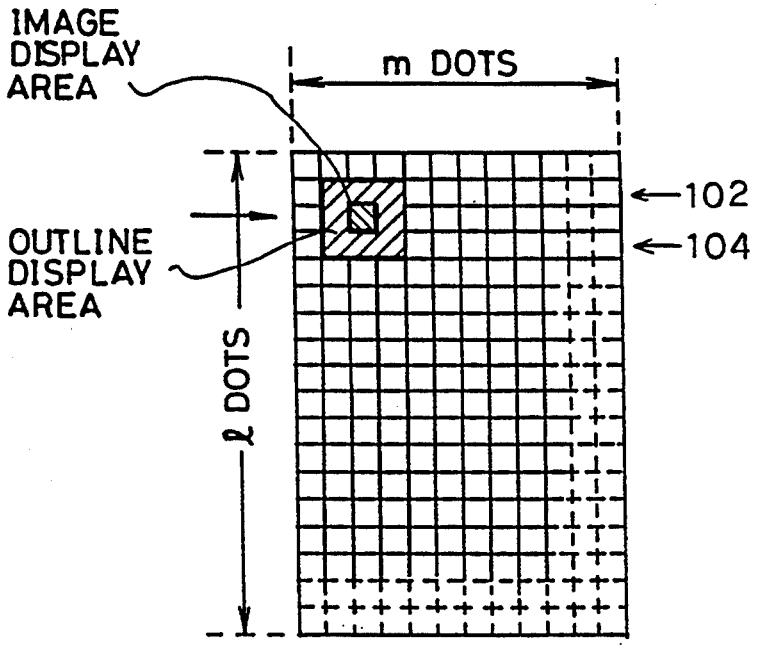
FIG. 10 PRIOR ART
FIG. 10 is a structural diagram of a font.
Figure 11:
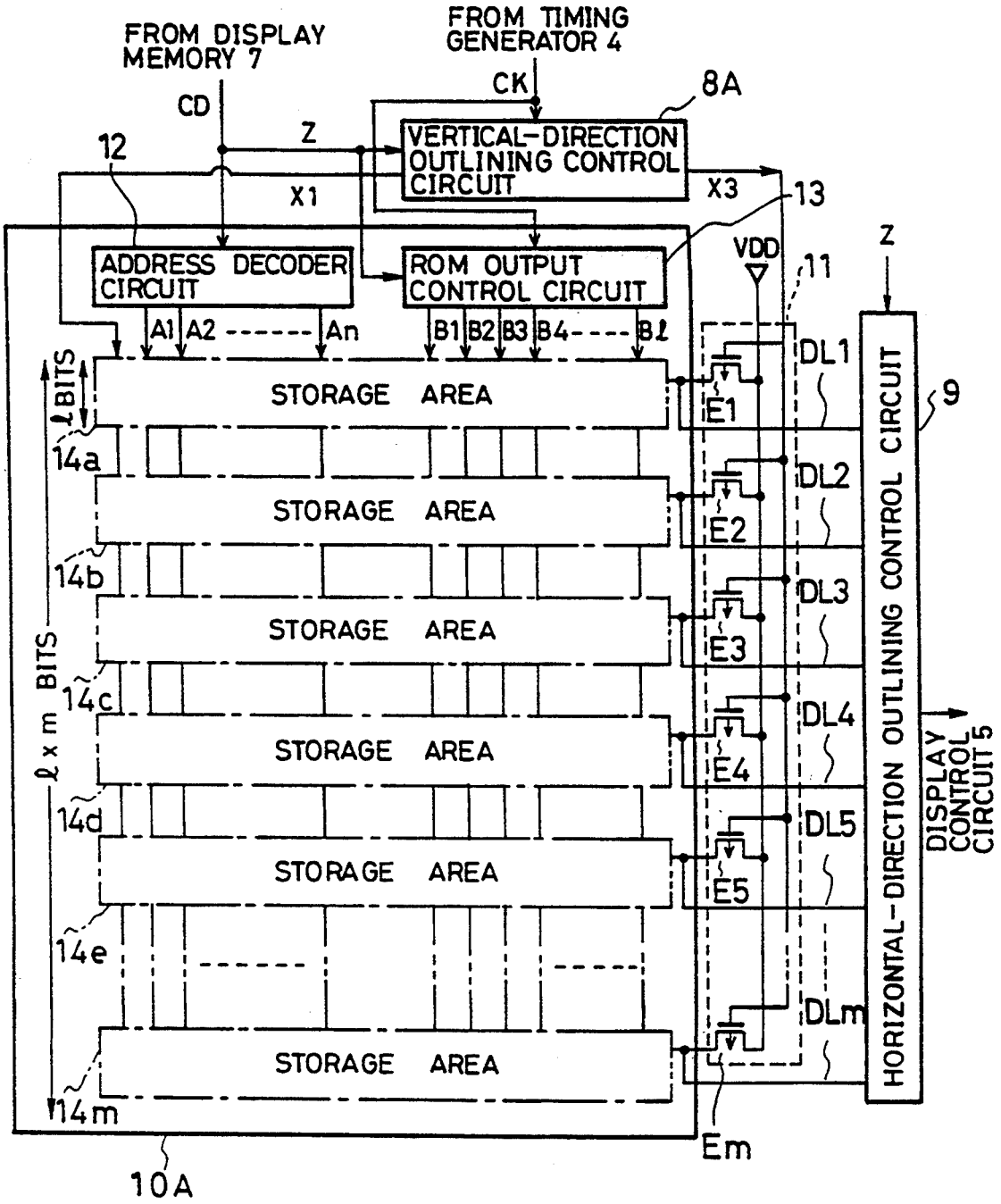
FIG. 11 PRIOR ART
FIG. 11 is a structural diagram of key parts illustrated in the block diagram of FIG. 8.

A single font is composed of l×m dot pixels, for example, as shown in FIG. 10. The character ROM 10B has a storage capacity of l×m×n dots for storing n character fonts.

Figure 3:
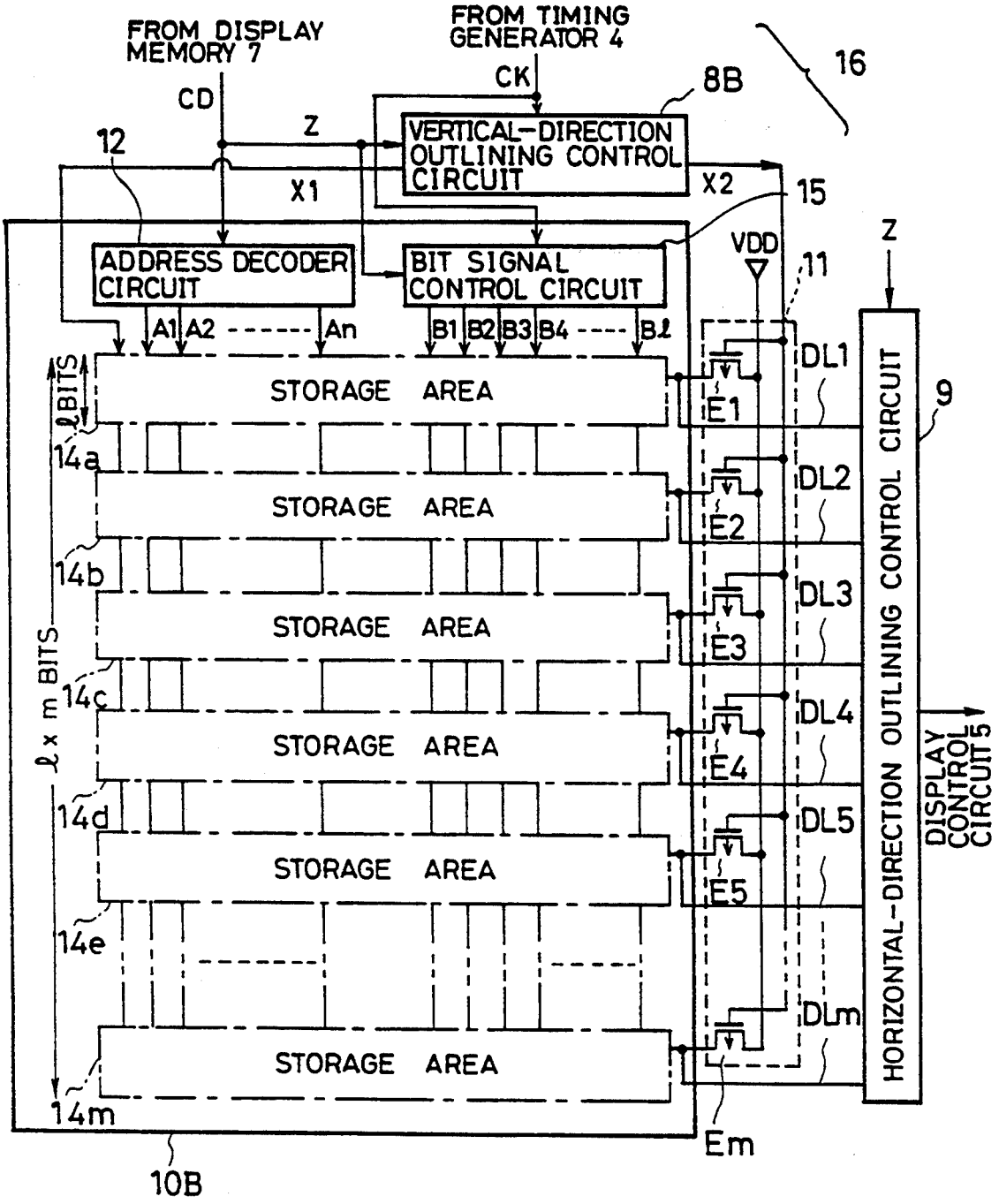
FIG. 3 is a structural diagram of key parts illustrated in the block diagram of FIG. 1.

FIG. 3 is a structural diagram illustrating the character ROM 10B which is the key part of the present invention, the vertical-direction outlining control circuit 8B and the ROM data output control circuit 11, together with the horizontal-direction outlining control circuit 9.

The character ROM 10B comprises the same address decoder circuit 12 as the prior art to which code data from the display memory 7 are input, a bit signal control circuit 15 to which a clock signal CK from the timing generator 4 and an outlining instruction signal Z from the display memory 7 are input and which can simultaneously output a bit signal corresponding to the current scanning and two bit signals adjacent to the bit signal in response to the outlining instruction signal Z, and m storage areas 14*a* through 14*m*. Address decode signals A1 through An output from the address decoder circuit 12 and bit signals B1 through Bl output from the bit signal control circuit 15 are supplied to each of the storage areas 14*a* through 14*m*. Data stored in each of the storage areas 14*a* through 14*m* are input into the horizontal-direction outlining control circuit 9 through the data lines DL1 to DLm. The read control means 16 of the present invention is constructed by the vertical-direction outlining control circuit 8B and the bit signal control circuit 15.

Figure 4:
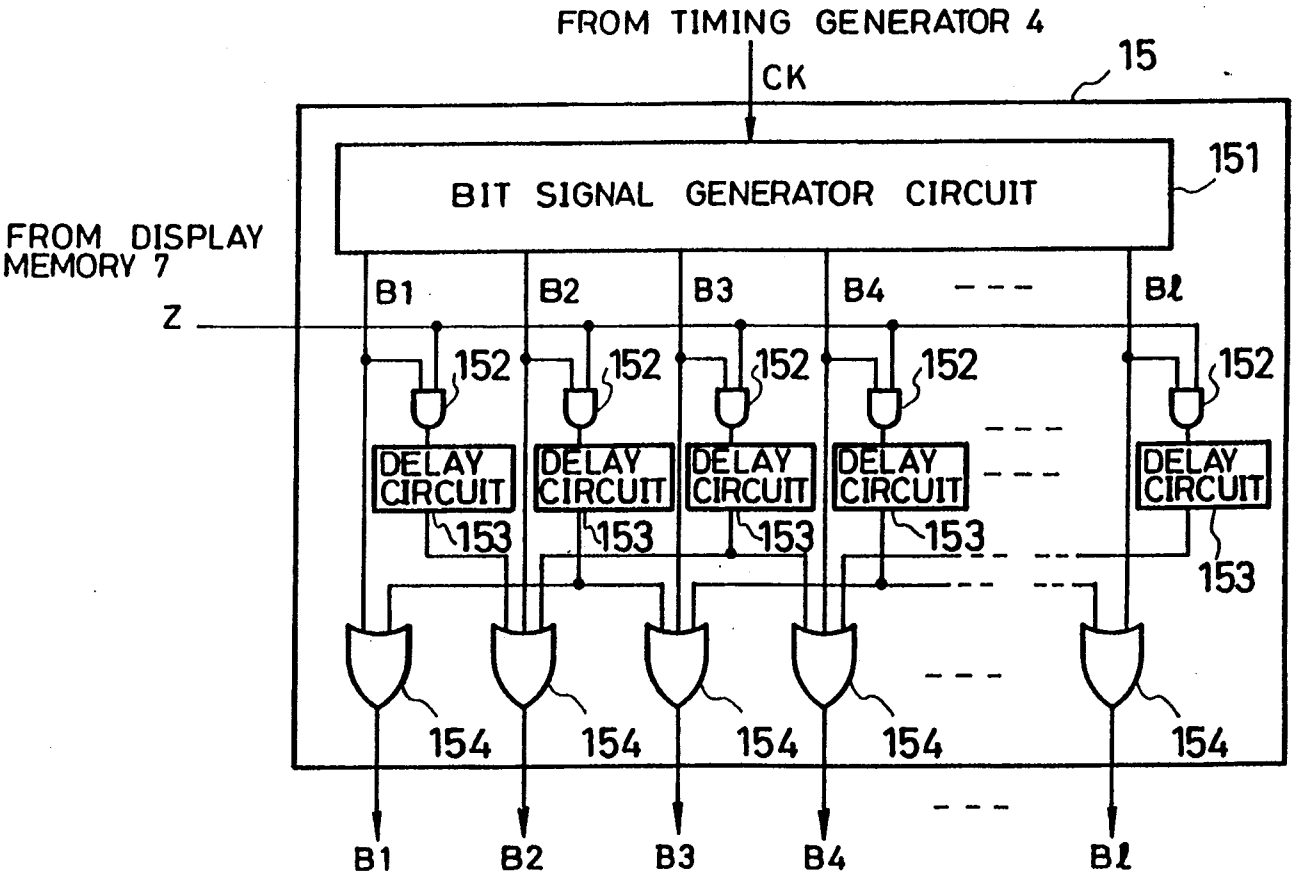
FIG. 4 is a diagram illustrating an example of the bit signal control circuit of FIG. 3.

FIG. 4 is a diagram of the internal configuration of the bit signal control circuit 15 which is provided in place of the ROM output control circuit 13 of the prior art. The bit signal control circuit 15 of this embodiment consists of a bit signal generator circuit 151 for generating bit signals B1 through Bl sequentially upon each scanning in response to a display clock CK from the timing generator 4, an l number of AND circuits 152 to which these bit signals B1 through Bl and the outlining instruction signal Z from the display memory 7 are input, an l number of delay circuits 153 for delaying the output of each AND circuit 152 by a predetermined time, and an l number of OR circuits 154 to which the bit signals B1 to Bl, and their adjacent bit signals are input through the AND circuits 152 and the delay circuits 153. The outputs of the OR circuits 154 are output as the final bit signals B1 through Bl. In other words, a bit signal corresponding to the current scanning is output by a bit signal directly input from the bit signal generator circuit 151 to the respective OR circuit 154, and when the outlining instruction signal Z is active at "H", bit signals corresponding to the previous scanning and the following scanning are output simultaneously from the bit signal input into the respective OR circuit 154 through the respective AND circuit 152 and the respective delay circuit 153. For instance, when a bit signal B3 is generated from the bit signal generator circuit 151, the bit signal B3 is output directly and adjacent bit signals B2 and B4 are output simultaneously after the elapse of a predetermined time. The delay time set to the delay circuits 153 is the sum of the pulse width of the bit signal and the pulse width of the second precharge signal X2 (time T of FIGS. 5(A) through (J).

In FIG. 3, the outlining instruction signal Z from the display memory 7 and the clock CK from the timing generator 4 are input into the vertical-direction outlining control circuit 8B. The precharge signal X1 output from the vertical-direction outlining control circuit 8B is input into each of the storage areas 14*a* through 14*m*.

The ROM data output control circuit 11 is composed of m P-channel MOS transistors E1 through Em, whose drains are connected to the respective data lines DL1 through DLm and whose sources are commonly connected to a precharge power supply VDD.

Figure 12:
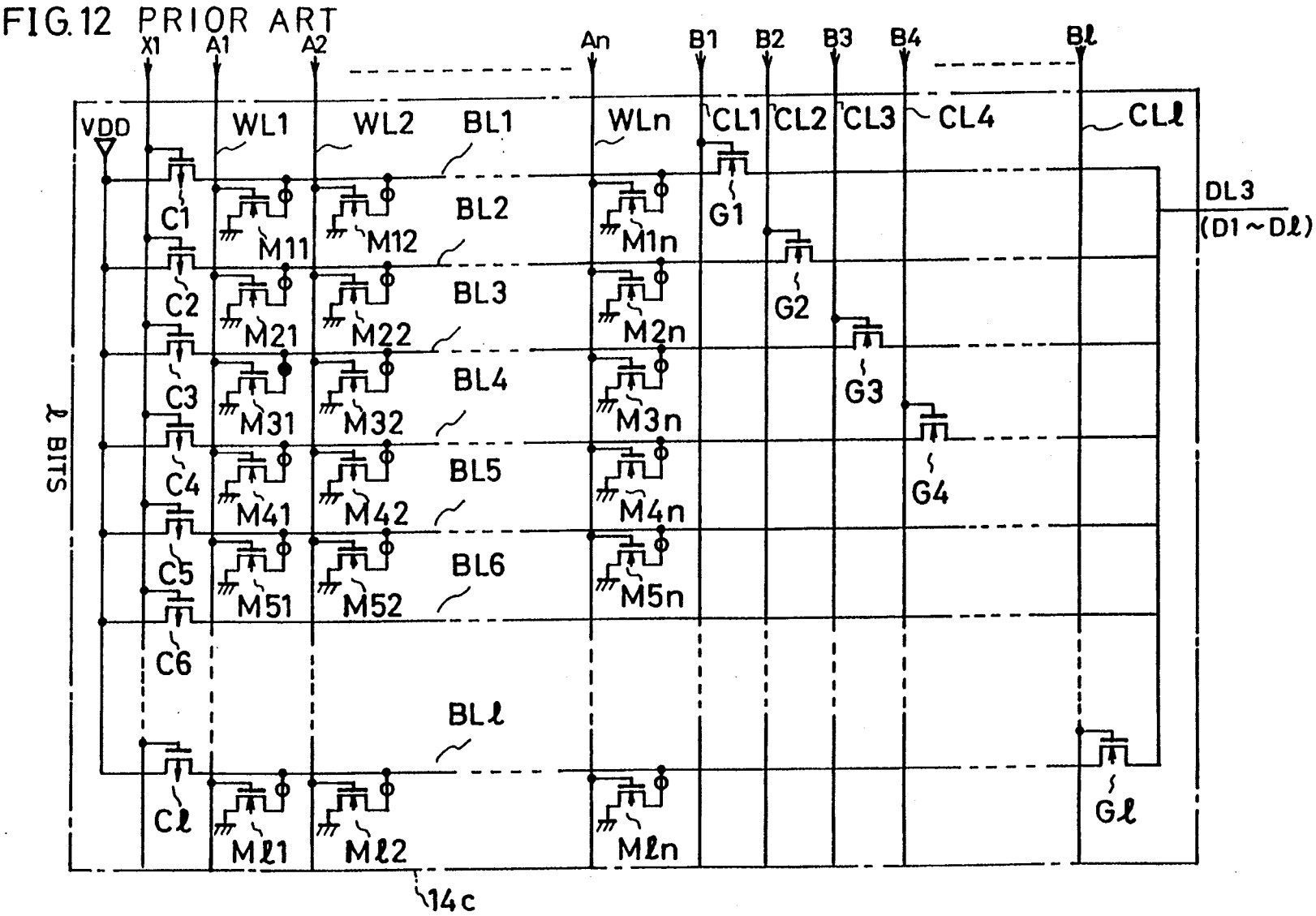
FIG. 12 PRIOR ART
FIG. 12 is a structural diagram of the storage areas of the character ROM.

To the gates of the P-channel MOS transistors E1 through Em, the precharge signal X2 is applied from the vertical-direction outlining control circuit 8B. As shown in FIG. 12, the concrete circuit of each of the storage areas 14*a* through 14*m* is a so-called OR type ROM in which bit lines connecting memory cells corresponding to the same bit position of each character font data are arranged in parallel for each column of the character font data and the bit lines BL1 through BLl thus arranged in parallel are commonly connected to a single data line through the respective output gate transistors G1 through Gl. The concrete structure of the horizontal-direction outlining control circuit 9 is the same as that of FIG. 13.

A description is subsequently given of the operation of the thus structured screen display device.

FIGS. 5(A) through (J) are timing charts of the access operation of the character ROM 10B. In FIG. 1, as described previously in the section related to the prior art, when the horizontal synchronous signal HSYNC and the vertical synchronous signal VSYNC are input into the synchronous signal input circuit 1, signals related to these synchronous signals are output to the oscillator circuit 2 and the display position detection circuit 3. The oscillator circuit 2 generates a predetermined oscillation output to the timing generator 4 based on the input synchronous signals, and the display position detection circuit 3 detects the image display position of a preset screen based on the input synchronous signals in order to adjust timing of displaying an image.

Meanwhile, when code data for displaying characters and patterns are input into the input control circuit 6 from the unshown microcomputer, code data such as signals for displaying and not displaying an image, an outlining instruction signal and character codes are written continuously onto the display memory 7 in response to a clock from the timing generator 4. The contents of the display memory 7 are read sequentially, the read code data are input into the character ROM 10B, and the outlining instruction signal Z is input into the vertical-direction outlining control circuit 8B, the horizontal-direction outlining control circuit 9 and a bit signal control circuit 15 in the character ROM 10B.

Figure 5:
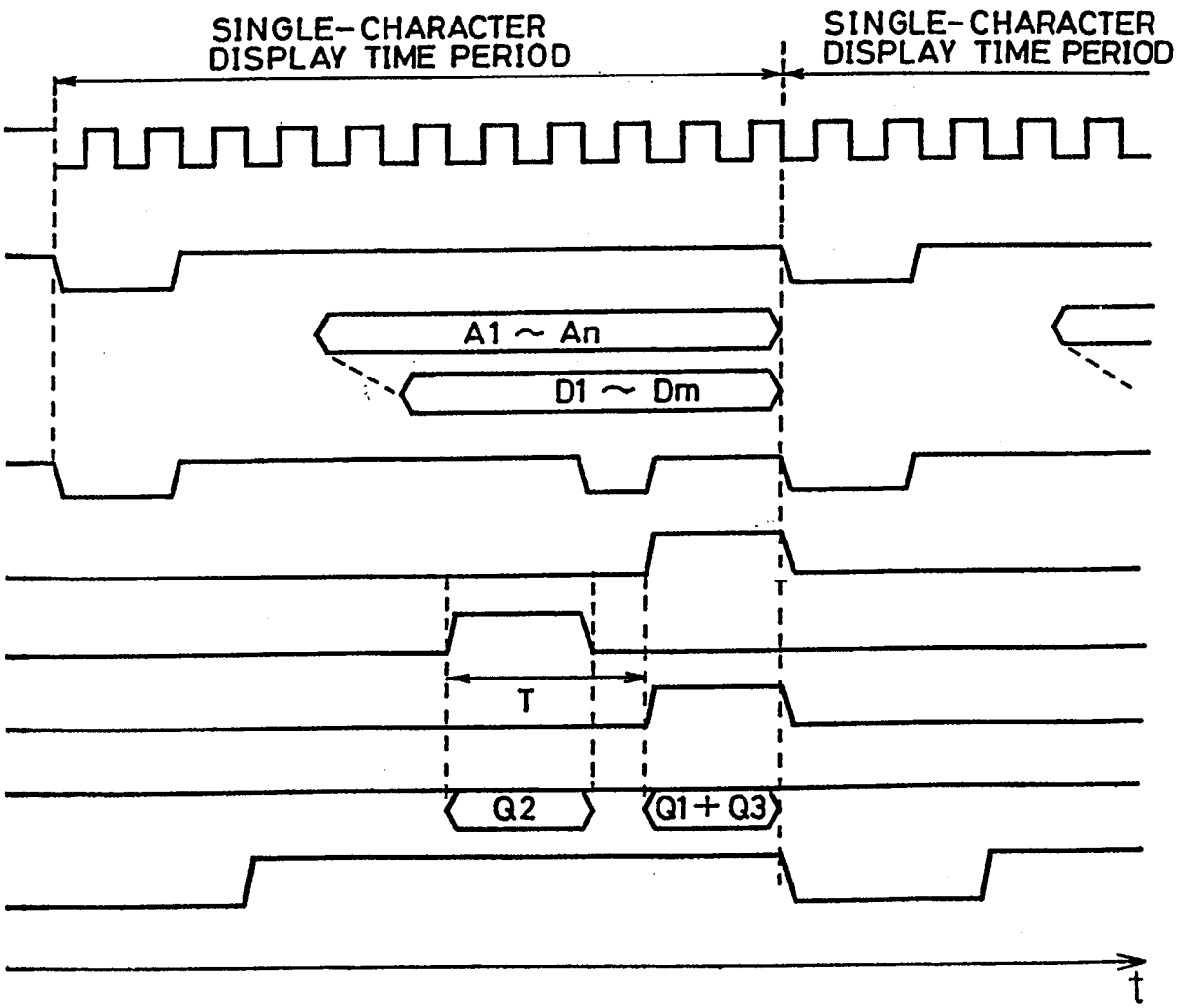
FIGS. 5(A) through 5(J) are timing charts showing the access operation of the character ROM of the embodiment.

Thereby, the address decoder circuit 12 of the character ROM 10B generates address decode signals A1 through An shown in FIG. 5(C) corresponding to the input code data and the storage areas output character font data D1 through Dm shown in FIG. 5(D).

In other words, the vertical-direction outlining control circuit 8B outputs a precharge signal X1 shown in FIG. 5(B) which is set at an "L" level at the beginning of the single-character display time period. The bit lines BL1 through BLl of each storage area are precharged while the precharge signal X1 is at an "L" level. A character code from the display memory 7 is input into the character ROM 10B, whereby the address decoder circuit 12 of the character ROM 10B provides to the storage areas 14*a* through 14*m* an address decode signal corresponding to the input character code from the address decode signals A1 through An shown in FIG. 5(C). Thereby, data corresponding to the address decode signal are output as character font data D1 through Dm shown in FIG. 5(D).

In each storage area, the bit signals B1 through Bl are output sequentially upon each scanning in response to the display clock CK input from the timing generator 4 to the bit signal control circuit 15 of the character ROM 10B so that character font data D1 through Dl are sequentially read out upon each scanning.

When the vertical-direction outlining control circuit 8B receives the outlining instruction signal Z, the circuit 8B outputs the precharge signal X2 shown in FIG. 5(E) which becomes "L" once at the beginning of the single-character display time period and once near the end of the period, and precharges the data lines DL1 through DLm of the character ROM 10B while the signal is at "L". When the bit signal control circuit 15 outputs the bit signal B3 shown in FIG. 5(G), for example, at the time of scanning, data Q2 being scanned currently shown in FIG. 5(I) is output, and when the circuit simultaneously outputs the bit signals B2 and B4 shown in FIGS. 5(F) and (H), data Q1+Q3 shown in FIG. 5(I) which is the logical sum of data Q1 previously scanned (past) and data Q3 to be scanned next (future) is output. In other words, when the N-channel transistors G2 and G4 of FIG. 12 are turned on at the same time and the address decode signal A1 is output, memory cells M21 and M41 are read simultaneously. Therefore, if any one of the memory cells outputs "L", "L" is output. That is, a value of the logical sum at active "L" is output.

In other words, a value of the logical sum of data on dots above and below an image to be displayed and data on the display image being scanned currently are obtained at the same time within the single-character display time period. The thus obtained data Q2 and Q1+Q3 are input into the horizontal-direction outlining control circuit 9.

Figure 13:
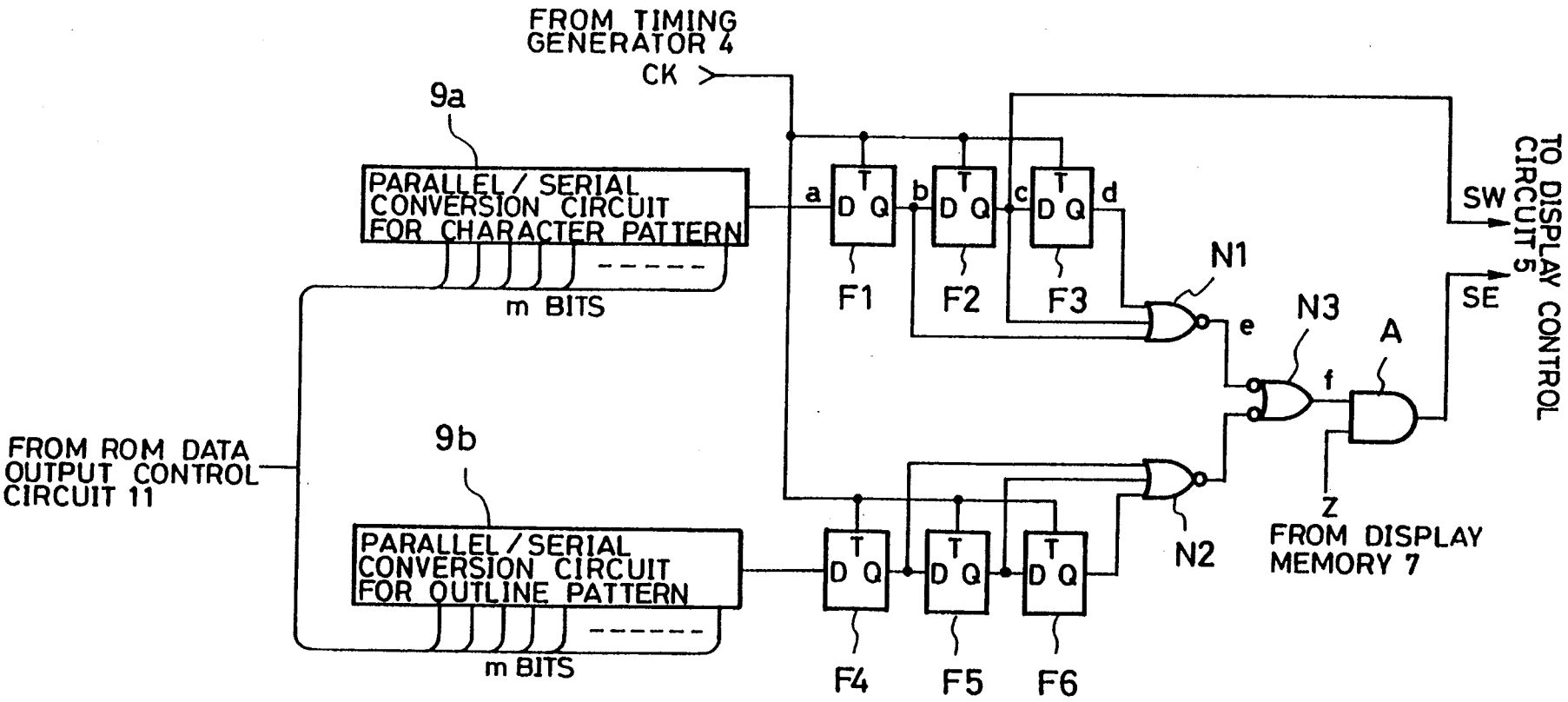
FIG. 13 PRIOR ART
FIG. 13 is a diagram illustrating an example of the horizontal-direction outlining control circuit.

At this time, the parallel/serial conversion circuit 9*a* for a character pattern shown in FIG. 13 receives the data Q2 being scanned currently upon input of the data Q2. The parallel/serial conversion circuit 9*b* for an outline pattern receives the data Q1+Q3 upon input of Q1+Q3, a value of the logical sum of data on dots above and below the display image area being scanned currently. As described in the foregoing, data of the parallel/serial conversion circuit 9*a* for a character pattern (or the parallel/serial conversion circuit 9*b* for an outline pattern) is supplied to the flip-flop F1 (or F4), the flip-flops F1, F2 and F3 (or F4, F5 and F6) operate reversely sequentially in response to the clock CK provided from the timing generator 4, and the flip-flop F2 outputs the character display signal SW. The output of the NOR circuit N1 to which the outputs of the flip-flops F1, F2 and F3 have been input and the output of the NOR circuit N2 to which the outputs of the flip-flops F4, F5 and F6 have been input are supplied to the NOR circuit N3, which outputs the outline display signal SE through the AND circuit A. Then, the character display signal SW and the outline display signal SE are supplied to the display control circuit 5 so as to control display such as display colors, and then to the unshown CRT.

In the case of scanning the position shown by the arrow in FIG. 10, data on the image display area, that is, data for obtaining an image, is supplied from the parallel/serial conversion circuit 9*a* for a character pattern to the flip-flop F1. Meanwhile, both data scanned previously and to be scanned next, that is, data on dots above and below the image display area of FIG. 10, are supplied from the parallel/serial conversion circuit 9*b* for an outline pattern to the flip-flop F4. Thereafter, the time length of the outline display signal SE obtained as the output of the NOR circuit N3 and corresponding to data scanned previously, being scanned currently and to be scanned next is extended by the operation of the afore-mentioned horizontal-direction outlining control circuit 9 to enable the outline of an image in a horizontal direction thereof to be displayed. Therefore, the outline of the image in a vertical direction thereof can be displayed with both data scanned previously and to be scanned next and the outline of the image in a horizontal direction thereof can also be displayed by extending the time length of these data.

Figures 16A, 16B:
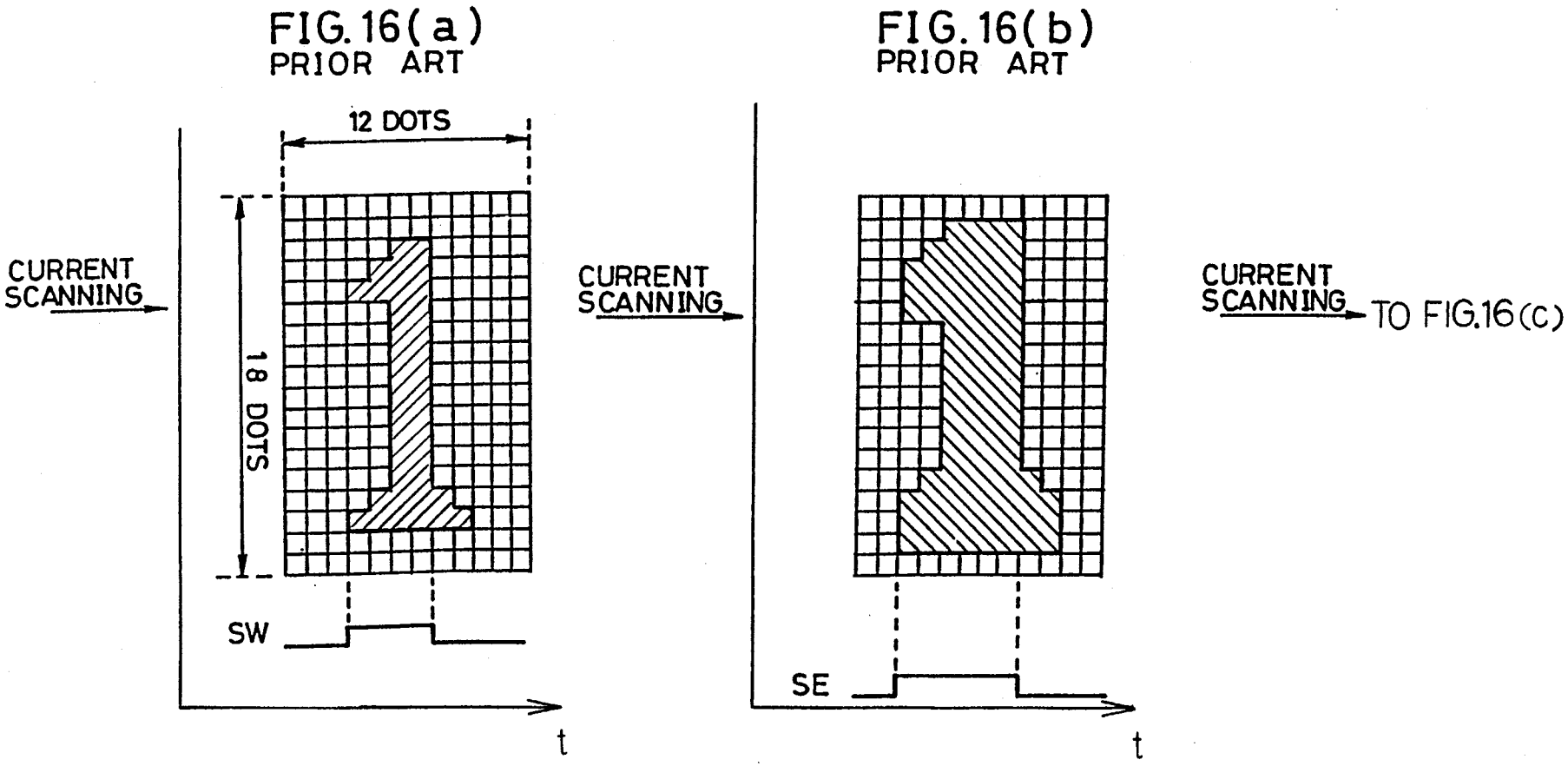
FIG.16(a) PRIOR ART
FIG.16(b) PRIOR ART
FIGS. 16(A) through 16(C) are diagrams showing examples of patterns in an outlined display.
Figure 16C:
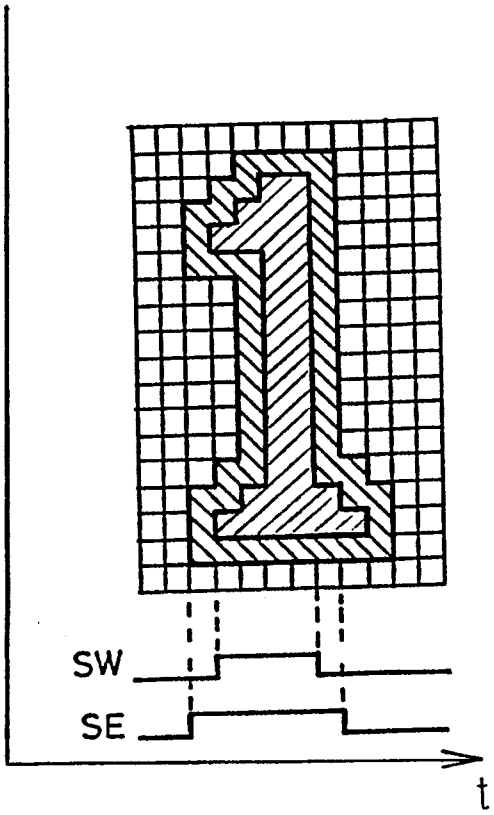
FIG.16(c) PRIOR ART

In a case where a font for outline display is "1", the font is displayed as shown in FIGS. 16(A) through (C). When a position shown by an arrow is being scanned currently, the character display signal SW and the font are such as shown in FIG. 16(*a*). The outline display signal SE at this time and a pattern for outline display are such as shown in FIG. 16(*b*) An image displayed with the character display signal SW and the outline display signal SE is such as shown in FIG. 16(*c*) which illustrates the font "1" outlined in both vertical and horizontal directions thereof.

Embodiment 2

Figure 6:
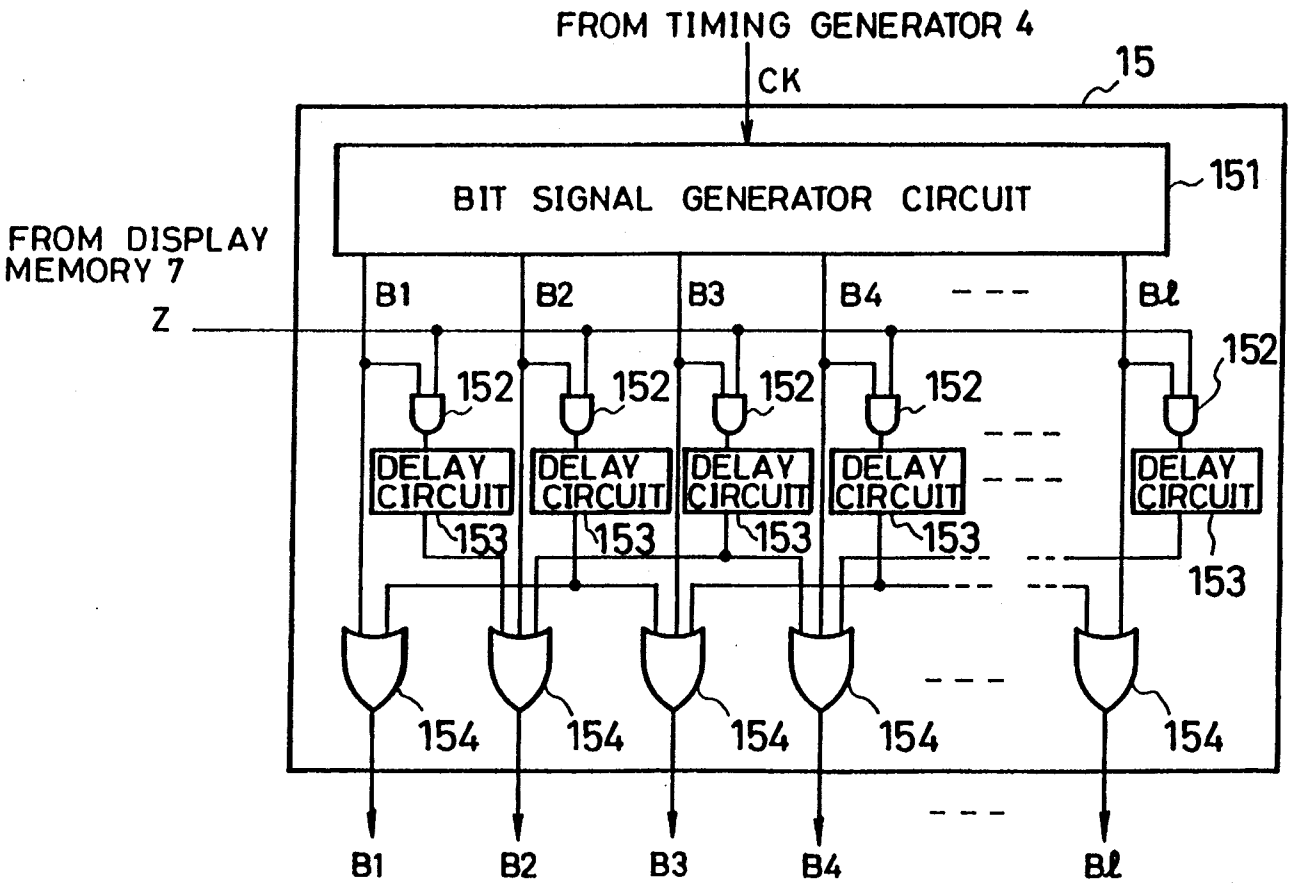
FIG. 6 is a diagram of another example of the bit signal control circuit of FIG. 3.
Figure 7:
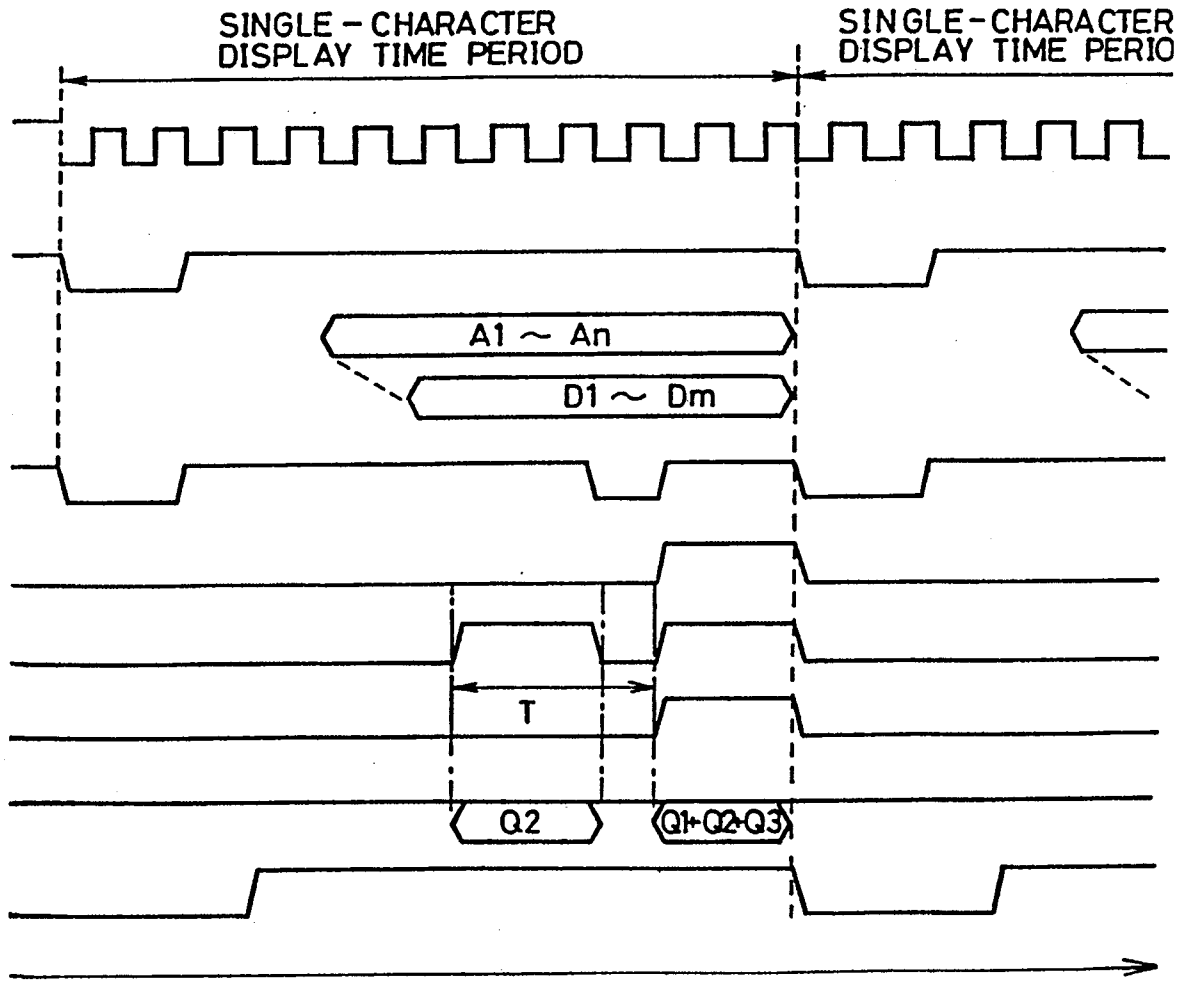
FIGS. 7(A) through 7(J) are timing charts showing the access operation of the character ROM using the bit signal control circuit of FIG. 6.
Figure 8:
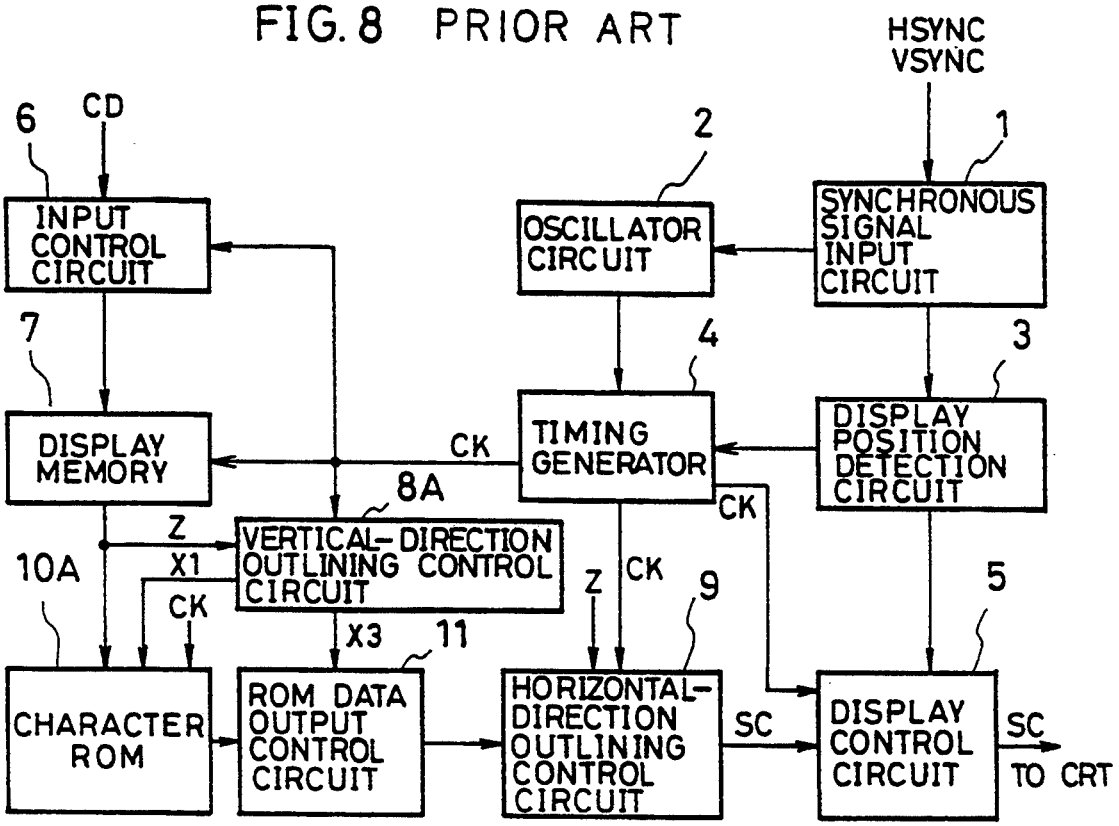
FIG. 8 PRIOR ART
FIG. 8 is a block diagram of the prior art.
Figure 9:
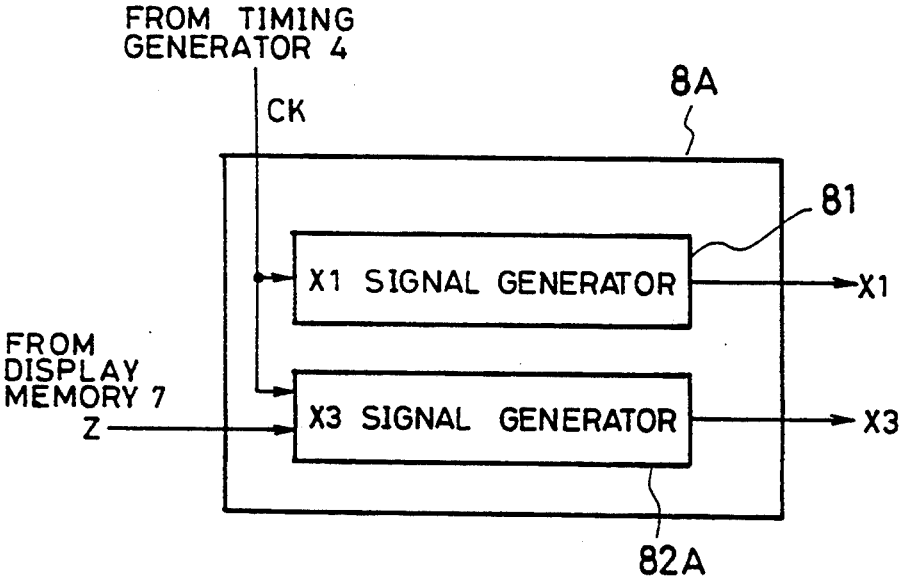
FIG. 9 PRIOR ART
FIG. 9 is a diagram illustrating an example of the vertical-direction outlining control circuit of FIG. 8.

In the above embodiment 1, data Q1+Q3 on the logical sum of data scanned previously and to be scanned next for outlining an image in a vertical direction thereof is read. The data may be further added with data being scanned currently and the thus obtained data Q1+Q2+Q3 on the logical sum of these data scanned previously, being scanned currently and to be scanned next may be read. The bit signal control circuit 15 in this case is such as shown in FIG. 6. That is, the bit signals B1 through Bl generated by the bit signal generator circuit 151 are input into the respective OR circuits 154 directly and through the respective AND circuits 152 and the respective delay circuits 153. The timing chart of this embodiment is shown in FIGS. 7(A) through (J). In this embodiment, the same effect as the aforementioned Embodiment 1 can be obtained, and in addition, the circuit configuration of the horizontal-direction outlining control circuit shown in FIG. 13 is simplified because construction for outlining a character pattern being scanned in a horizontal direction thereof, that is, the flip-flop F3 and the NOR circuits N1 and N3, is unnecessary and the output of the NOR circuit N2 may be input into the AND circuit A as an OR circuit.

In the above Embodiments 1 and 2, the character ROM is of a type which is read by precharge, but the present invention can be applied to a type of character ROM which is read with a sense amplifier.

As described in the foregoing, according to the present invention, the screen display device uses the character ROM which is composed of memory cells corresponding to each column of character font data arranged in parallel and which outputs data on the logical sum of data stored in these memory cells when a plurality of memory cells are read simultaneously, and further comprises read control means which accesses the character ROM twice within a single-character display time period at the time of outline display, once for reading data being scanned currently and the other time for simultaneous reading of both data scanned previously and to be scanned next for vertical-direction outlining. Therefore, the character ROM needs to be read only twice for outline display, thus making it possible to effect stable outlining operation even at high clock frequencies.

All the data including data being scanned currently can be processed in the following step of the horizontal-direction outlining by simultaneous reading of all the data scanned previously, being scanned and to be scanned next, thus simplifying a circuit configuration for horizontal-direction outlining.

What is claimed is:

1. A screen display device for displaying an outlined character on a display screen in a computer system, wherein the outlined character includes a plurality of horizontal scan lines, wherein each scan line is displayed for a single-character display time period, the screen display device comprising:

a display memory for storing character codes for displaying characters and patterns on a screen;

a character ROM for prestoring character data for the characters and patterns, wherein the character data prestored in the character ROM describes a character in terms of one or more vertical columns of data;

read control means for accessing said character ROM twice during a single-character display time period for a given scan line, wherein one access is for reading data at the time of displaying the given scan line and the other access is for reading data corresponding to scan lines before and after the given scan line to achieve vertical-direction outlining;

wherein the character ROM comprises:

a plurality of memory cells corresponding to each vertical column of character data, wherein the plurality of memory cells are arranged in parallel with their outputs coupled together so that the data in the plurality of memory cells is ORed together when the plurality of memory cells are read simultaneously;

a first signal generator, coupled to the read control means, for generating a first precharge signal once at the beginning of the single-character display time period and inputing the signal into said character ROM; and a second signal generator, coupled to the read control means and responsive to an outlining instruction signal from the display memory, for generating a second precharge signal twice within the single-character display time period and inputing the signal into a ROM data output control circuit.

2. The screen display device according to claim 1, wherein said read control means further comprises:

a bit signal control circuit including a bit signal generator circuit for generating bit signals sequentially upon each scanning in response to a display clock signal;

one or more AND circuits for receiving bit signals from said bit signal generator circuit and the outlining instruction signal from said display memory;

one or more delay circuits for delaying the outputs of said AND circuits by a predetermined time;

one or more OR circuits for receiving bit signals generated from said bit signal generator circuit and adjacent bit signals through said AND circuits and said delay circuits, wherein the one or more OR circuits generate control signals such that a bit signal at the time of scanning is output from said OR circuit and supplied to said character ROM, and such that bit signals adjacent to the bit signal at the time of scanning are output according to the outlining instruction signal and supplied to said character ROM.

3. The screen display device according to claim 1, wherein said read control means further comprises:

a bit signal control circuit which consists of a bit signal generator circuit for generating bit signals sequentially upon each scanning in response to a display clock signal;

one or more AND circuits for receiving bit signals from said bit signal generator circuit and the outlining instruction signal from said display memory;

one or more delay circuits for delaying the outputs of said AND circuits by a predetermined time; and one or more OR circuits for receiving bit signals generated from said bit signal generator circuit and adjacent bit signals through said AND circuits and said delay circuits, wherein the one or more OR circuits generate control signals such that a bit signal at the time of scanning is output from said OR circuit and supplied to said character ROM, and that bit signals adjacent to the bit signal at the time of scanning are output simultaneously with the bit signal at the time of scanning according to the outlining instruction signal and supplied to said character ROM.

* * * * *